US005269738A

United States Patent [19]

Boren

[11] Patent Number: 5,269,738

[45] Date of Patent: Dec. 14, 1993

[54] APPARATUS AND METHOD FOR TESTING AND EXERCISING LUMBAR MUSCLES

[76] Inventor: John P. Boren, 9940 Old Katy Rd., Houston, Tex. 77055

[21] Appl. No.: 854,540

[22] Filed: Mar. 19, 1992

[51] Int. Cl.[5] ..... A63B 21/00

[52] U.S. Cl. ..... 482/134; 482/100; 482/137; 482/908

[58] Field of Search ..... 482/1-10, 482/98-103, 131, 133-138, 908

[56] References Cited

U.S. PATENT DOCUMENTS

| | | | |
|---|---|---|---|
| 3,581,739 | 6/1971 | Brandt | 482/134 X |
| 4,333,340 | 6/1982 | Elmeskog | 482/134 X |
| 4,462,252 | 7/1984 | Smidt et al. . | |
| 4,478,411 | 10/1984 | Baldwin . | |
| 4,500,089 | 2/1985 | Jones . | |
| 4,600,189 | 7/1986 | Olschansky et al. . | |
| 4,628,910 | 12/1986 | Krukowski . | |
| 4,645,205 | 2/1987 | Wolff | 482/113 X |
| 4,647,040 | 3/1987 | Ehrenfried | 482/131 |
| 4,702,108 | 10/1987 | Amundsen et al. . | |
| 4,725,055 | 2/1988 | Skowronski . | |
| 4,725,056 | 2/1988 | Rehrl et al. . | |
| 4,732,380 | 3/1988 | Maag | 482/134 |
| 4,759,540 | 7/1988 | Yu et al. | 482/908 X |
| 4,834,365 | 5/1989 | Jones . | |
| 4,836,536 | 6/1989 | Jones . | |
| 4,902,009 | 2/1990 | Jones . | |
| 4,930,768 | 6/1990 | Lapcevic . | |
| 5,004,230 | 4/1991 | Jones | 482/134 X |
| 5,005,830 | 4/1991 | Jones . | |
| 5,007,634 | 4/1991 | Jones | 482/134 |
| 5,070,863 | 12/1991 | McArthur et al. | 482/134 X |

*Primary Examiner*—Robert Bahr
*Attorney, Agent, or Firm*—Bush, Moseley & Riddle

[57] ABSTRACT

An exercise machine (10) and method for testing and exercising the lumbar muscles of a user or patient (P) while in a secured seated position on a seat (20) by the user exerting a rearward force against a back pad (32) on a pivoted movement arm (30) is described. The user (P) is positioned on seat (20) with feet on a horizontal plate (82) and tibias restrained against upward movement by thigh pads (72). Upward vertical movement of platform (80) relative to pads (72) secures the user (P) tightly on the machine (10) and permits a limited rocking movement of the pelvis during exercising as shown at (D) in FIG. 12. A strain gauge (172) anchored at one end (176, 178) to the fixed support frame (14) is mounted for connection to a pulley wheel (132) for static testing and for disconnection from pulley wheel (132) during the exercise mode.

15 Claims, 7 Drawing Sheets

FIG. 3
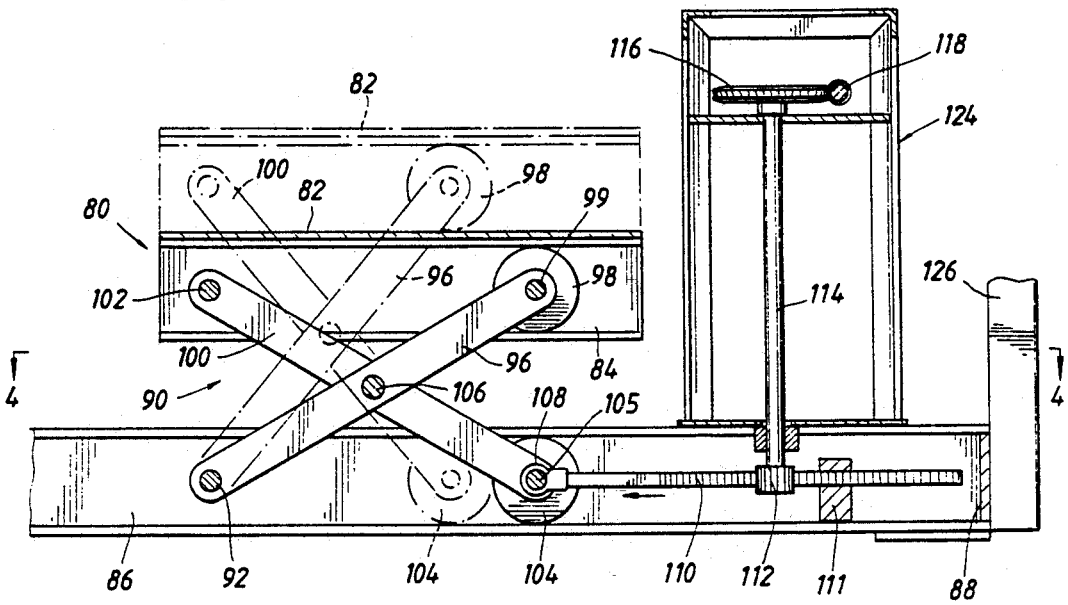
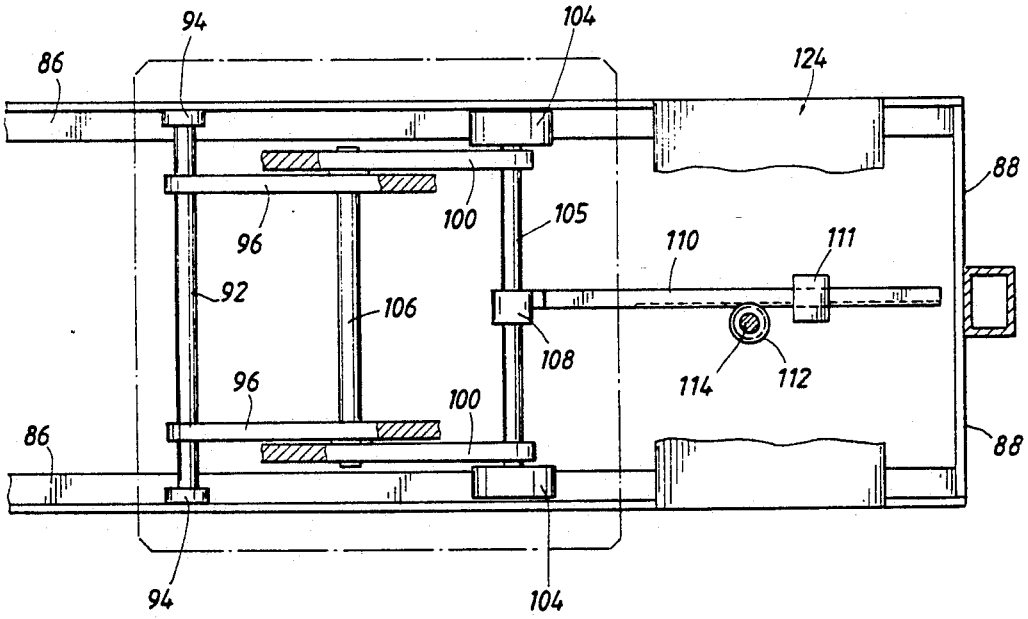
FIG. 4

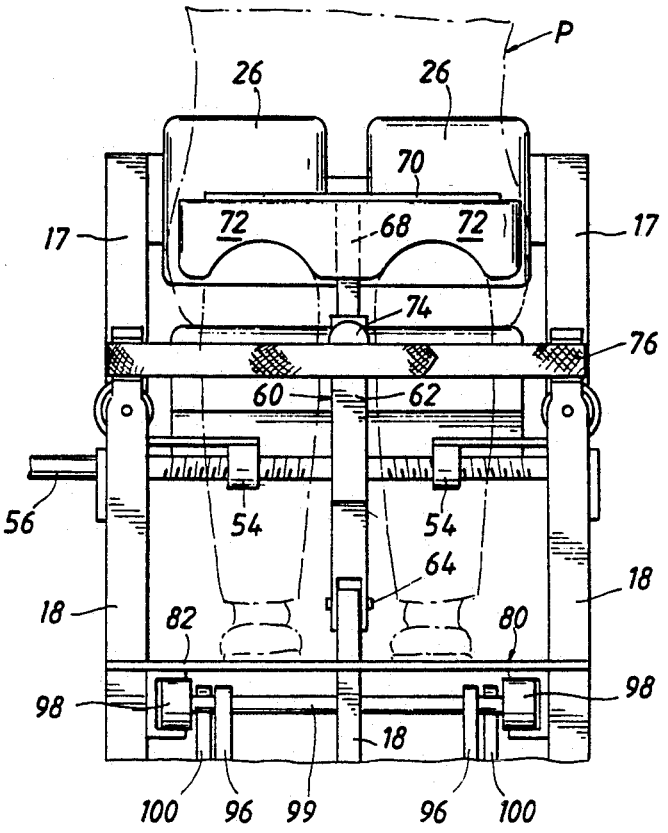
FIG.11
FIG.12
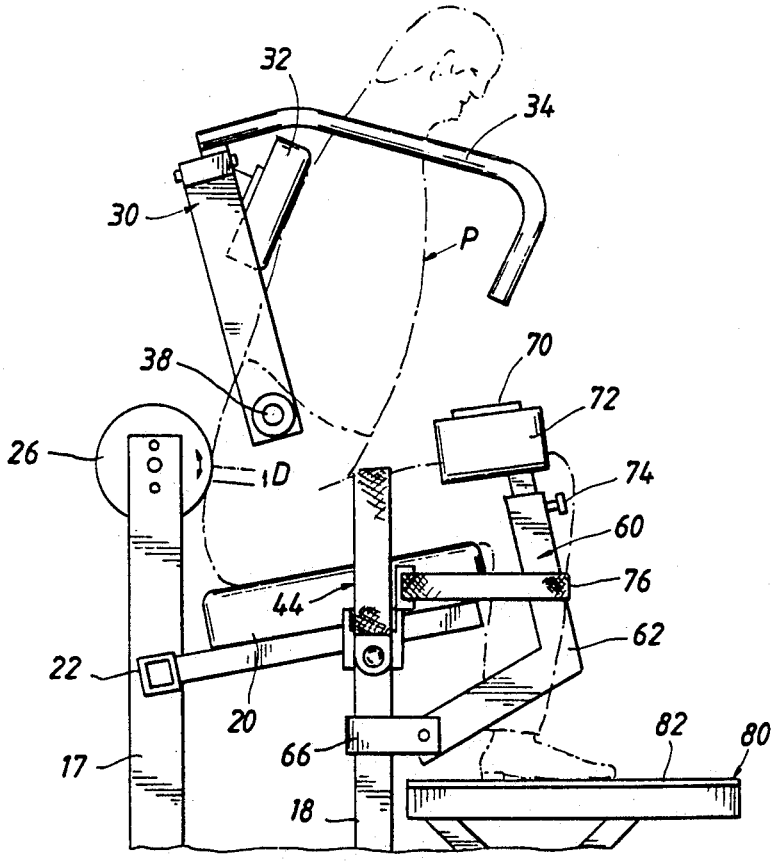

APPARATUS AND METHOD FOR TESTING AND EXERCISING LUMBAR MUSCLES

FIELD OF THE INVENTION

This invention relates to an apparatus and method for testing and exercising lumbar muscles, and more particularly to such an apparatus and method in which a user is secured in a seated position and exerts a rearward back motion against a pivoted movement arm for the testing and exercising of the lumbar muscles.

BACKGROUND OF THE INVENTION

Heretofore, such as shown in U.S. Pat. No. 5,005,830 dated Apr. 16, 1991, exercise machines have been provided for testing and exercising lumbar or abdominal muscles of a user or patient. In such machines, the user is strapped in a seated position and then force is applied in a generally horizontal direction against the femurs of a user to push the femurs rearwardly and downwardly for anchoring the pelvis and preventing any movement of the pelvis during testing and exercising. In order to detect any movement of the pelvis during an exercise or test, a measuring device is connected to a rear pelvic pad contacting the body of the user. If any movement of the user is detected, the restraining straps are tightened and additional force is applied against the femurs. The application of such a strapping or pushing force against the femurs sufficient to prevent any movement of the pelvis during exercising or testing provides discomfort to the user and also requires substantial time in order to insure that no movement of the pelvis occurs during testing and exercising.

An actuating or movement arm in the '830 patent is mounted for pivotal movement about a horizontal axis and has a pad engaged by the upper back of a user with a weight resistance operatively connected to the movement arm. The movement arm is contacted by the user's back and a back and forth bending movement of the upper torso of the user exerted against the back pad effects pivotal movement of the movement arm. In anchoring or preventing movement of the pelvis during testing and exercising, the lumbar muscles are isolated. A strain gauge is provided for measuring the static strength of the lumbar muscles in each of different angular positions of the spine. The strain gauge is not anchored to the fixed frame, but instead is mounted for movement with the movement arm during the entire testing and exercising program. During static testing, the strain gauge is tensioned between the movement arm and a sprocket which is releasably locked to the fixed supporting frame to prevent movement of the sprocket.

SUMMARY OF THE INVENTION

The present invention is directed to an exercise apparatus and method in which a user is seated on a seat against an upper back rest on a pivoted movement arm and exerts a rearward force against the back rest for pivoting the movement arm rearwardly for the testing and exercising of the lumbar muscles of the lower trunk of the body. The exercise apparatus and method are particularly designed so that a limited rocking movement of the pelvis is provided both during the static testing of the lumbar muscle strength and the subsequent exercising of the lumbar muscles. As a result of permitting a limited rocking movement of the pelvis, (1) the testing and exercising of a user or patient will not be uncomfortable, (2) the patient may be easily positioned in the exercise machine in a minimum of time for testing and exercising, and (3) more accurate measurements may be achieved of lumbar muscle strength by having the strain gauge measuring the strength anchored to the fixed support frame for the exercise machine. A rocking movement of the pelvis as low as around ¾ inch and as high as around three inches under some conditions may be provided by the exercise machine of the present invention.

The rocking movement of the pelvis while the patient is tightly strapped in a seated position on the exercise machine is achieved by having the feet of the user supported on a horizontal platform with the lower legs or tibias in a vertical relation and restrained against upward movement by vertically adjustable leg pads on the thighs adjacent the knees. Then the platform is moved vertically upward relative to the leg pads to exert a compressive force against the tibias for securing the user or patient within the exercise machine for testing and exercising the lumbar muscles.

For measuring of the static strength of the lumbar muscles in each of the different angular positions of the spine as determined by the angular position of the movement arm, a strain gauge in operable position has one end secured to the fixed frame and the other end releasably connected to a pulley wheel releasably secured or locked to the movement arm. Movement of the movement arm and wheel tensions the strain gauge for obtaining the measurement of the static strength of the lumbar muscles. Upon completion of the static testing, the strain gauge is disconnected from the wheel and remains in an inoperable stationary position anchored to the fixed support frame until again connected to the wheel for additional static testing. Thus, the strain gauge does not move with the movement arm during the subsequent exercise mode against weight resistance provided by a weight stack.

It is an object of this invention to provide an exercise machine and method for testing and exercising lumbar muscles of a patient or user in a seated position on a seat with the user strapped tightly on the seat and exerting a rearward force on a back rest while permitting a limited rocking movement of the pelvis during exercising of the lumbar muscles.

A further object of this invention is to provide an improved method for exercising the lumbar muscles of a user or patient by using a plurality of operational steps for tightly securing the user to the machine by supporting the feet on a horizontal support and raising the horizontal support vertically relative to thigh restraints adjacent the kness to provide a compressive force against the lower legs or tibias extending in a generally vertical direction.

It is a further object of this invention to provide such an exercise machine and method in which the feet of a patient are supported on a horizontal platform with the tibias in a vertical relation restrained against vertical movement by thigh pads adjacent the knees with the platform mounted for vertical movement relative to the thigh pads for tightly securing the patient on the machine for testing and exercising.

An additional object of the invention is to provide a strain gauge arrangement for such an exercise machine for measuring the static strength of the lumbar muscles with the strain gauge anchored at one end to a fixed support frame minimizing movement of the strain gauge and providing a long life.

BRIEF DESCRIPTION OF DRAWINGS

Other objects and advantages of this invention will become apparent from the following more detailed description taken in conjunction with the attached drawings in which:

FIG. 3 is an enlarged side elevational view, partly in section, showing a horizontally extending platform for supporting the feet of a user with means for moving the platform vertically;

FIG. 4 is a plan view taken generally along line 4—4 of FIG. 3 and showing the linkage means for raising and lowering the platform;

FIG. 11 is a front elevational view similar to FIG. 9 but showing the upper leg restraint device in position over the thighs adjacent the knees of the user; and FIG. 12 is a side elevational view of the user in secured position with the horizontal platform raised for tightly securing the tibias and showing the user exerting a rearward force against the back rest of the movement arm for moving the movement arm in a rearward counterclockwise direction for lifting the weight stack in the exercise mode.

DESCRIPTION OF THE INVENTION

Figure 1:
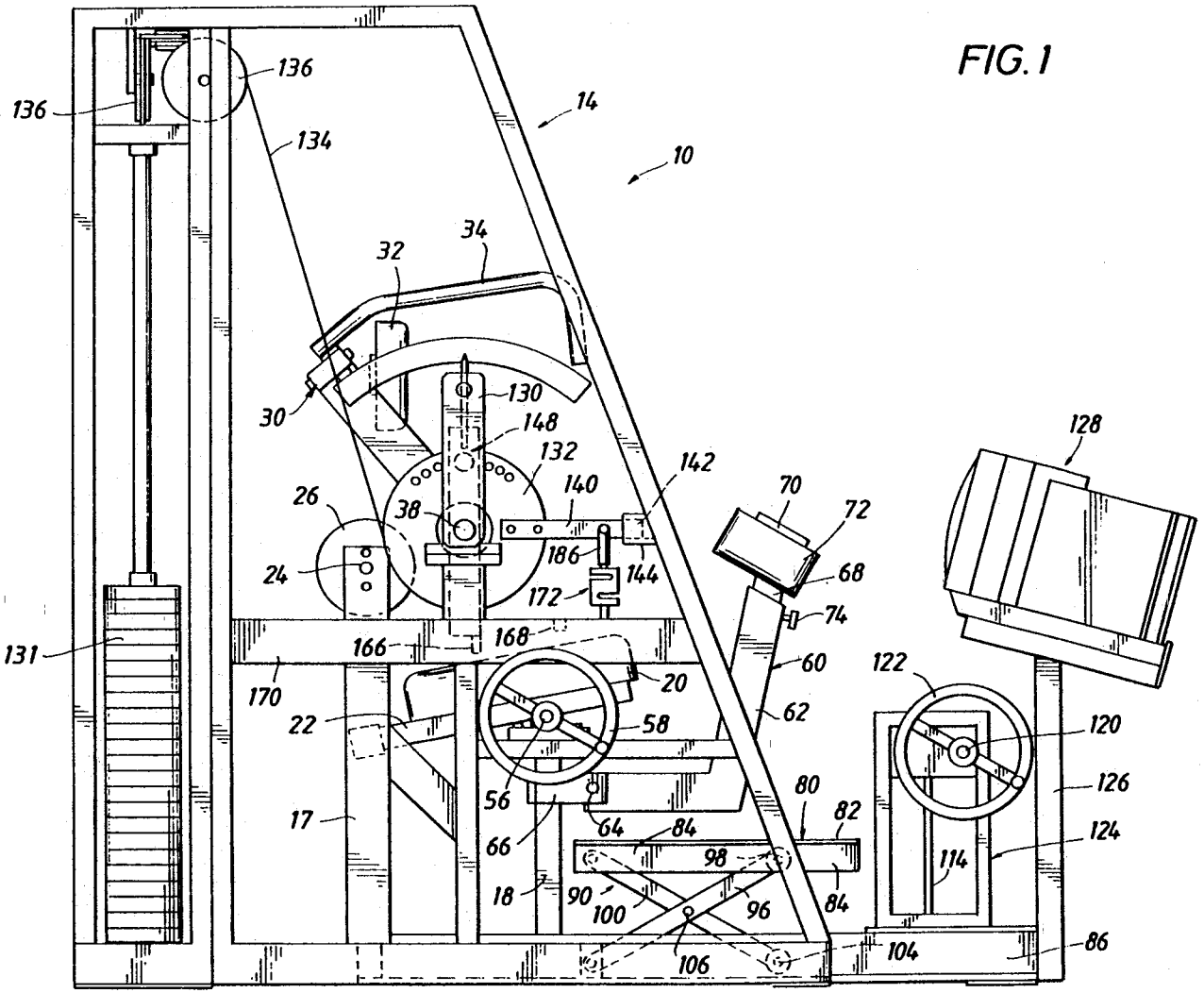
FIG. 1 is a side elevational view of the preferred embodiment of the exercise machine of this invention.
Figure 2:
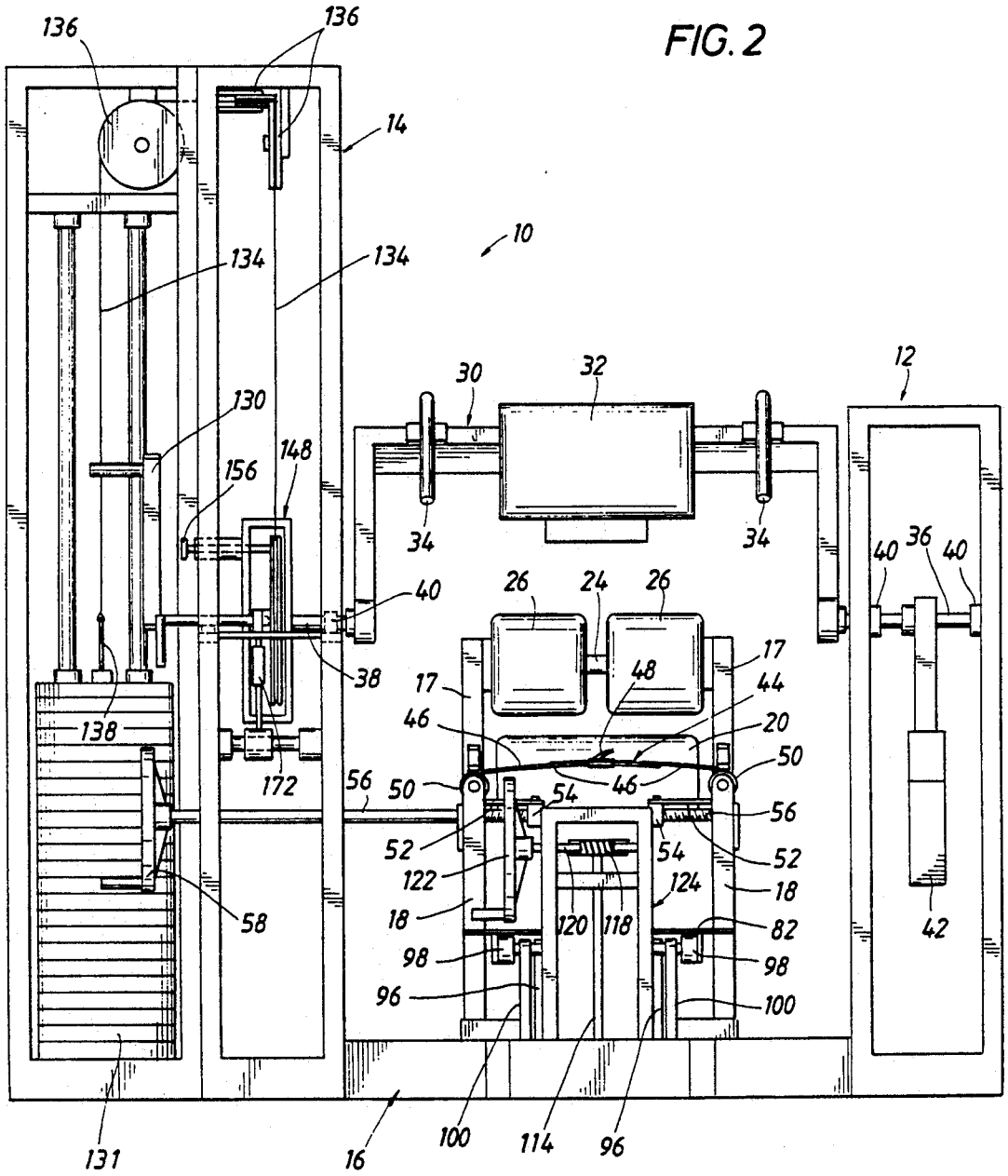
FIG. 2 is a front elevational view of the exercise machine shown in FIG. 1.

Referring now to the drawings for a better understanding of this invention, and more particularly to FIGS. 1 and 2, an exercise apparatus or machine comprising the preferred embodiment of the present invention is shown generally at 10 and includes a pair of upstanding vertically extending side frames 12 and 14 connected by a horizontally extending base frame 16 supported on a floor. Side frames 12 and 14 include suitable vertical, horizontal, and other structural frame members secured together to form side compartments on which decorative panels may be mounted, if desired.

Vertical frame members 17 and 18 extend vertically upward from base frame 16. A seat 20 is fixed to horizontal frame members 22 extending between and secured to vertical frame members 17 and 18. A horizontal shaft 24 has its ends supported for rotation on frame members 17. A pair of cylindrical lower back pads or back rolls 26 are mounted on shaft 24 for rotation.

A movement arm generally indicated at 30 is mounted above seat 20 and has an upper back pad or back rest 32 secured thereto and adapted to contact the back of a user with the user exerting a rearward force against back rest 32 for pivotal movement of movement arm 30. Movement arm 30 has manual grip bars 34 which may be manually gripped by the user to position and stabilize the user on seat 20 but without any substantial pivotal force being exerted against bars 34. Arm 30 is of a crank shape having integral stub shafts 36 and 38 at opposite ends thereof extending in a horizontal direction to movement arm 30 for rotation about a horizontal axis. Suitable bearings 40 secured to side frames 12 and 14 mount stub shafts 36 and 38 for rotation. A counterweight 42 is secured to stub shaft 36 for rotation therewith.

Figure 9:
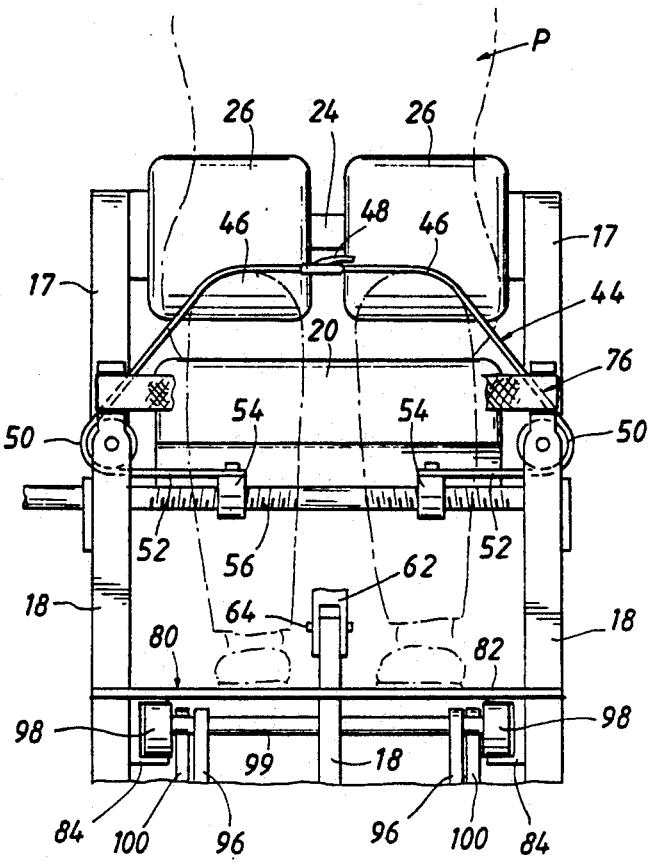
FIG. 9 is a front elevational view, partly schematic, of a portion of the exercise machine showing the user in an initial seated position with a lap strap secured above the knees of the user and the feet of the user supported on the horizontal platform.

For securing a user or patient in a seated position on seat 20 of exercise machine 10 for testing and exercising, a releasable lap strap generally indicated at 44 has end portions 46 which are releasably connected to each other by suitable clips or buckles 48 over the thighs of a user as shown particularly in FIG. 9. End portions 46 of strap 44 extend about rollers 50 on vertical frame members 18 and have lower ends 52 secured to blocks 54 threaded onto externally threaded shaft 56. A hand wheel 58 on the end of shaft 56 effects movement of blocks 54 along shaft 56 for tightening of strap 44 upon rotation of shaft 56 by hand wheel 58.

For restraining upward movement of the legs of the user, a leg restraint device is shown generally at 60 and includes an angled shaped center post 62 pivotally mounted at 64 to bracket 66 and fixed to a center vertical frame member 18. Center post 62 is adapted to fit between the legs of a user when the user is seated on seat 20. It is of a generally rectangular hollow shape for receiving an upper telescoping post member 68. Upper post member 68 has an upper horizontal plate 70 on which a pair of spaced leg pads 72 are secured to the lower surface thereof for fitting against the thighs of a user closely adjacent the knees as shown particularly in FIG. 11. A manually operated spring biased pin or plunger shown generally at 74 is manually operated for the vertical adjustment of upper post member 68 relative to lower post 62 thereby to place pads 72 against the thighs of a user upon the seating of a user on seat 20. An additional lower leg restraint strap is shown generally at 76 (see FIGS. 9 and 10) having its inner ends anchored at 78 and having overlapping outer end strap portions releasably secured to each other about the legs of a user in seated position by suitable releasable fasteners such as Velcro or releasable buckles.

Upon being seated on seat 20, the feet of the user are supported on a horizontally extending platform generally indicated at 80 and shown particularly in FIGS. 3 and 4. Platform 80 includes an upper horizontally extending plate 82 which is mounted for vertical movement to raise or lower the feet of the user. A pair of spaced upper channel-shaped members 84 are secured to plate 82. A lower fixed base portion of base 16 includes a pair of parallel lower channel-shaped frame members 86 connected at their ends by cross frame member 88. A linkage indicated generally at 90 connects upper channel-shaped members 84 to fixed lower channel-shaped members 86. Linkage 90 includes a lower shaft 92 extending between and mounted for rotation within bearings 94 secured to lower channel-shaped members 86. Links 96 are secured at one end to shaft 92 and have rollers 98 mounted on an opposite end fitting within upper channel members 84. Rollers 98 are mounted for rotation on shaft 99 extending between links 96. Links 100 are secured at one end to shaft 102 extending between upper channel members 84 and have rollers 104 at an opposite end fitting within lower channel members 86. Rollers 104 are mounted for relative rotation on shaft 105 extending between rollers 104 and links 100. A connecting shaft 106 connects links 96 and 100 to transfer loads between links 96 and links 100.

For actuation of linkage 90, a collar 108 is mounted on shaft 105 and has a toothed rack 110 extending therefrom supported on block 111. A pinion 112 in engagement with rack 110 is mounted on the lower end of shaft 114. A worm wheel 116 is mounted on the upper end of shaft 114. A worm gear 118 on shaft 120 engages worm wheel 116 in driving relation. A hand wheel 122 as shown particularly in FIG. 2 is connected to an end of shaft 120 which in turn is connected to worm gear 118. Upon manual operation of hand wheel 122, worm gear 118 rotates wheel 116, which rotates shaft 114 causing longitudinal movement of rack 110. Such movement of rack 110 causes shaft 105 to move rearwardly and thereby to pivot links 96 and 100 about respective shafts 92 and 105 for moving platform 80 in a vertical direction. A suitable housing generally indicated at 124 provides an enclosure for the worm gear arrangement. A post 126 extends upwardly from cross member 88 and has a suitable computer monitor shown generally at 128 mounted on the upper end of post 126 for viewing by the user as will be explained further.

Figure 5:
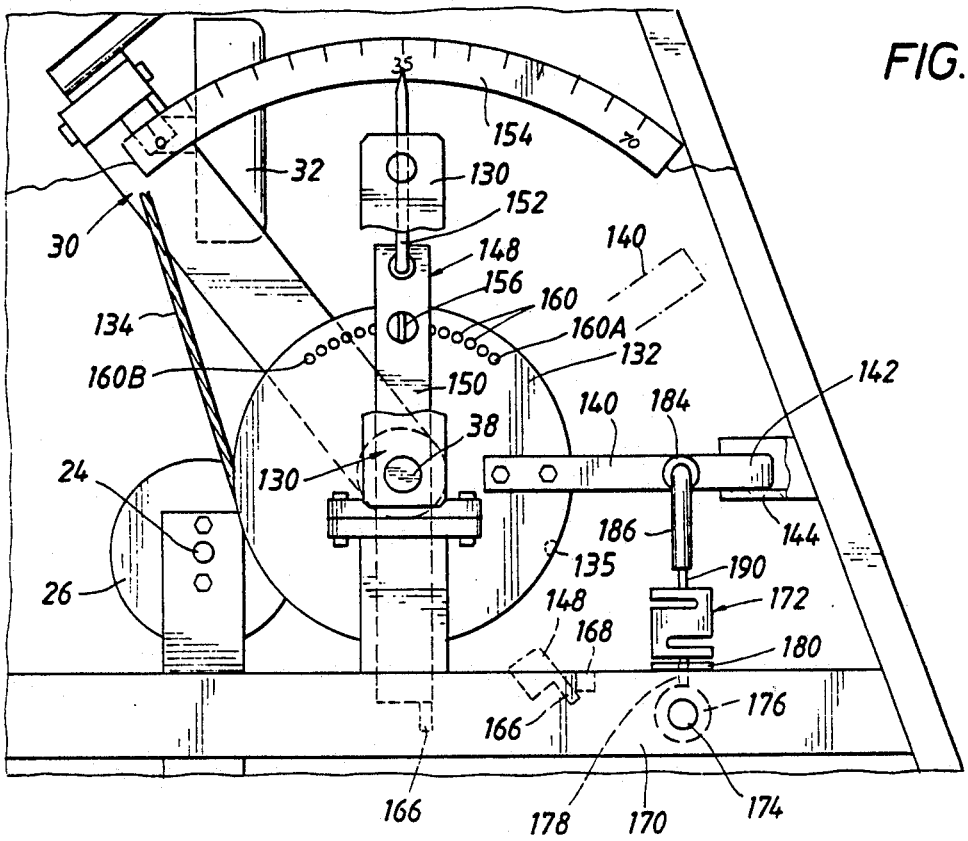
FIG. 5 is an enlarged side elevational view of releasable lock means for releasably connecting the movement arm to the pulley wheel and showing releasable locking means for releasably connecting the strain gauge to the pulley wheel.
Figure 6:
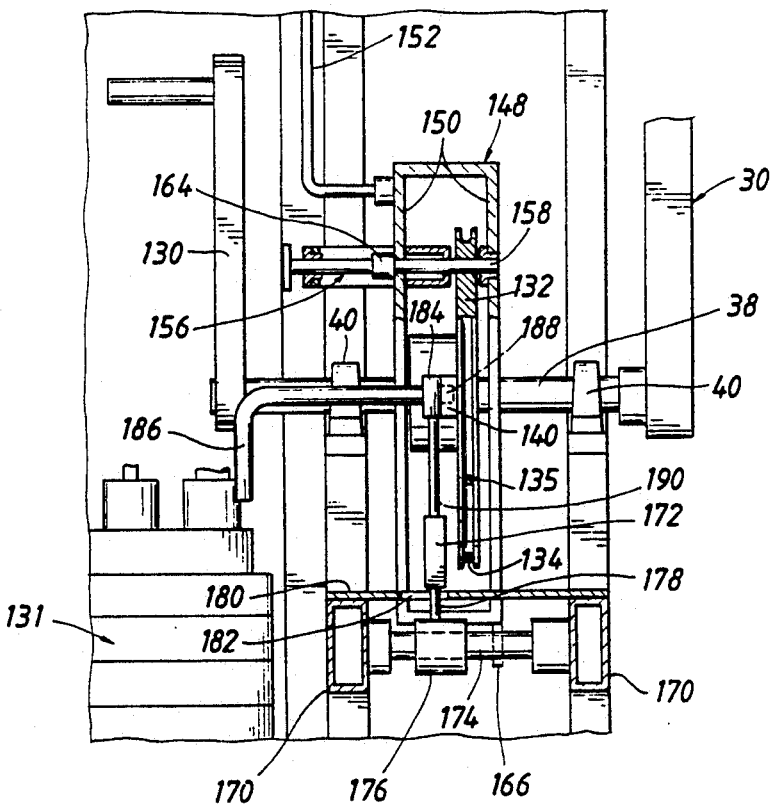
FIG. 6 is a front elevational view, partly in section, of the releasable lock means shown in FIG. 5 showing locking means for releasably connecting the movement arm to the pulley wheel and the strain gauge releasably connected to the pulley wheel as required for static testing of the user.

Referring now more particularly to FIGS. 5–8, the resistance weights for movement arm 30 and the drive connection between the resistance weights and movement arm 30 are illustrated for both the static test mode and the exercise mode which generally follows the static test mode. U-shaped movement arm 30 is secured to stub shaft 38 (see also FIG. 2) which is mounted for rotation within bearings 40. A manually operated crank arm 130 is secured to the end of stub shaft 38 and is utilized for manually adjusting the angular relationship of movement arm 30 relative to the resistance weights shown at 131 in FIGS. 1 and 2. In other words crank arm 130 is secured to movement arm 30 and rotates with it. A pulley wheel 132 is mounted for relative rotation on stub shaft 38. A cable 134 has one end anchored to pulley wheel 132 at 135 as shown in FIGS. 5 and 6 and extends about idler pulleys 136 to weight stack 131. An end of cable 134 is connected to weight stack 131 at 138 and the amount of resistance from weight stack 131 may be manually adjusted as well known to provide resistance from a predetermined number of weights.

Pulley wheel 132 has an extending arm 140 secured thereto. An extending end portion 142 of arm 140 is adapted to contact a fixed stop 144 secured to side frame 14 to limit the rotative movement of pulley wheel 132 in a clockwise direction as viewed in FIGS. 1 and 5 when pulley wheel 132 is releasably locked to shaft 38. Arm 140 has an opening 146 therethrough adjacent end portion 142. (see FIG. 8)

Figure 7:
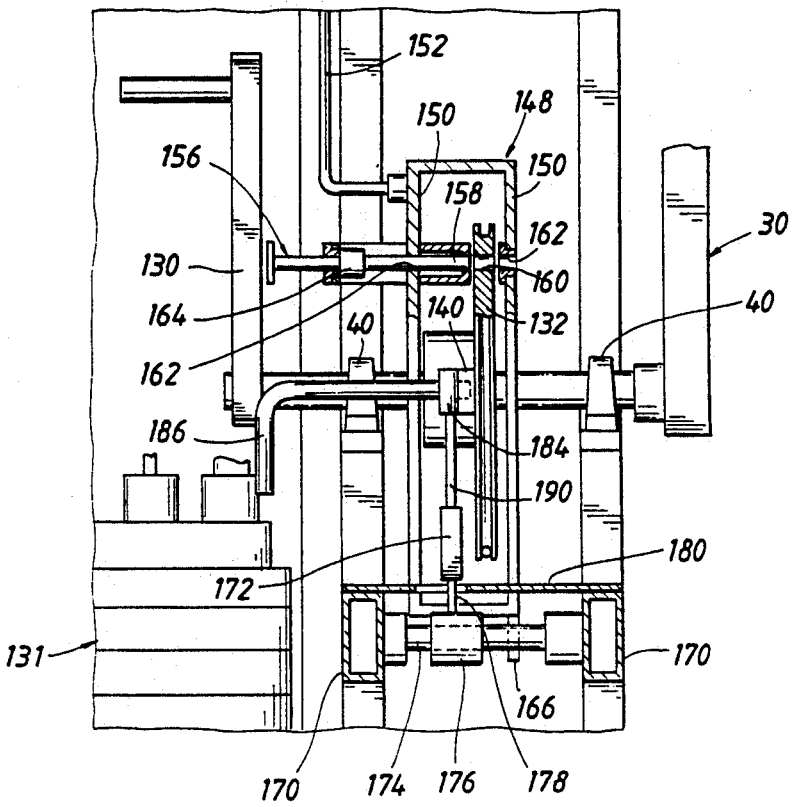
FIG. 7 is a front elevational view similar to FIG. 6 but showing the locking means for the movement arm disconnected from the pulley wheel to permit angular adjustment of the movement arm relative to the pulley wheel as necessary for static testing of the user at different angular positions.
Figure 8:
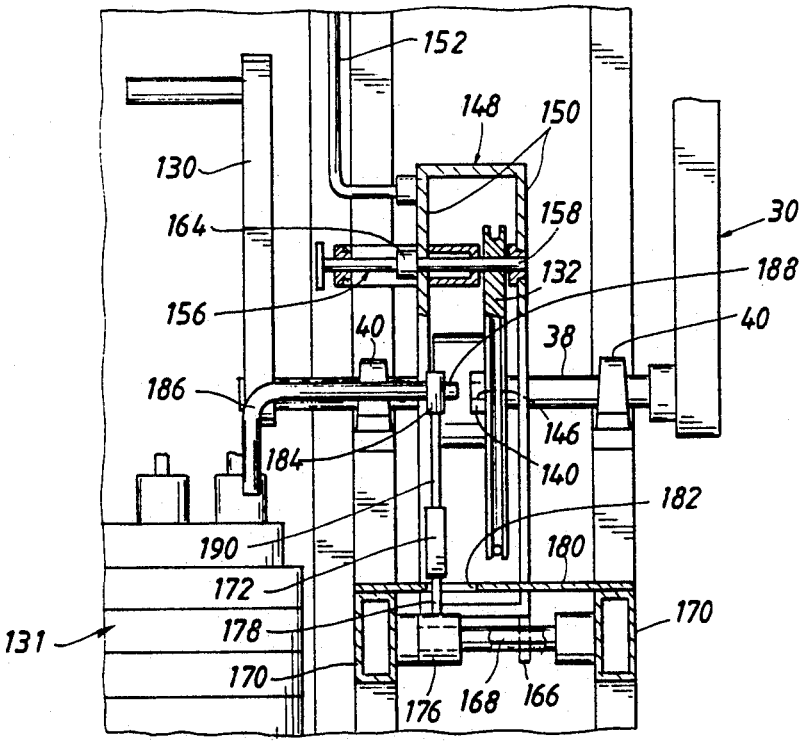
FIG. 8 is a front elevational view similar to FIGS. 6 and 7 but showing the locking means for the movement arm releasably locked to the pulley wheel and showing the strain gauge disconnected from the pulley wheel as in the exercise mode of the exercise machine.

Releasable locking means are provided to connect movement arm 30 in driving relation to pulley wheel 132 and weight stack 131. A box-like lever (see FIG. 6) having open sides is shown generally at 148 and is secured to stub shaft 38 for rotation therewith. Lever 148 includes front and rear plate members 150. Front plate member 150 has a pointer 152 secured thereto and cooperates with a fixed angular scale 154 to indicate the angular relation of movement arm 30 relative to a horizontal axis as shown in FIG. 5. Scale 154 is secured to side frame 14 and may for example be graduated from 0° to 70°. As shown in FIG. 5, pointer 152 is shown in a centered position at 35° with back rest or pad 32 of movement arm 30 extending in a generally vertical plane. For releasably connecting pulley wheel 132 to shaft 38 for rotation therewith, a manually actuated pin or rod generally indicated at 156 forms a releasable locking means and has an inner end 158 which may be received within a selected one of a plurality of openings 160 in pulley wheel 132. A rearmost opening is shown at 160B and a forward most opening is shown at 160A. Front and rear plates 150 of lever 148 have aligned openings 162 therein to receive inner end 158 as shown in FIG. 7. A stop 164 on pin 156 limits inward movement of pin 156 in a projected engaged position with pulley wheel 132 as shown in FIGS. 6 and 8, and limits outward movement of pin 156 in a retracted disengaged position as shown in FIG. 7.

To limit movement of lever 148 in a counterclockwise direction past 0° on scale 154, lever 148 has a lower projection 166 as shown particularly in FIG. 5 adapted to engage a cross bar 168 extending between horizontal frame members 17. As shown in the drawings, movement arm 30 upon adjustment of lever 148 may swing in an angular relation as much as 70° if pin 156 is secured within opening 160A and as little as 0° if pin 156 is received within opening 160B as shown in FIG. 5. Arm 140 engages stop 144 at the beginning and end of each cycle under the bias of weight stack 131 exerted by cable 134. For example, with lever 148 in the position of FIGS. 5 and 8 releasably locked to pulley wheel 132, back force of a user exerted against back rest 32 moves movement arm 30 in a counterclockwise position of 35° until stop 166 engages cross bar 168 as shown in broken lines in FIG. 5. Arm 140 and pulley wheel 132 likewise are rotated in a counterclockwise direction as indicated by broken lines in FIG. 5. Upon release of the back force of the user against back rest 32, weight stack 131 through cable 134 urges pulley wheel 132 in a clockwise direction to return arm 140 to stop 144 for the completion of a cycle.

A cycle comprises a positive movement of back rest 32 and arm 30 in a counterclockwise direction of 35° and a negative return movement of back seat 32 and arm 30 in a clockwise direction of 35°. If pin 156 is received within opening 160A (FIG. 5), a cycle of 70° would be obtained in a similar manner. The movement of movement arm 30 as set forth above is the type of movement for the exercise mode of exercise machine in which the weight stack 131 through cable 138 continuously urges pulley wheel 132 in a clockwise position to maintain arm 140 against stop 144 unless a rearward force is exerted against back seat 32 in a counterclockwise direction as viewed in FIGS. 1 and 5. While hand grips 34 are provided on movement arm 30, hand grips 34 are utilized only for positioning and maintaining the user in a seated position, and a pivotal force normally should not be exerted against hand grips 34 for rotating movement arm 30 as it is contemplated that the user should apply a force against back rest 32 for rotative movement of arm 30 and exercising of the lumbar or lower back muscles.

A static strength test to test the static strength of the lumbar muscles at each of the different angular positions of the spine is determined by the set angular position of movement arm 30 and lever 148 relative to pulley wheel 132 as provided by a selected opening 160. In order to measure the static strength of the lumbar muscles, a strain gauge generally indicated at 172 is provided. Strain gauge 172 is releasably locked to arm 140 in an operable position for the static test mode and is disconnected from arm 140 in an inoperable position for the exercise mode.

For mounting strain gauge 172, a support shaft 174 is secured between horizontal frame members 170 of fixed side frame 14. A sleeve or collar 176 is slidably mounted on support shaft 174 and a lower connecting pin 178 is secured between sleeve 176 and strain gauge 172. A plate member 180 is secured between frame members 170. An elongated slot 182 therein receives pin 178 as shown in FIGS. 6–8 for guiding strain gauge 172. An upper block 184 has a manually actuated handle 186 secured thereto on one side and has a projecting pin or prong 188 on an opposite side. An upper rod 190 is secured between strain gauge 172 and block 184. Inner prong or end 188 of handle 186 is adapted to fit selectively within opening 146 of arm 140.

FIG. 8 shows strain gauge 172 in an inoperable position for the exercise mode disconnected from arm 140 with inner end 188 removed from opening 146.

FIGS. 6 and 7 show strain gauge 172 in an operable position connected to arm 140 for measuring the static strength of the lumbar muscles with inner end 188 received within opening 146 of arm 140 and moving with pulley wheel 132 and movement arm 30. Handle 186 is manually gripped and pushed inwardly with collar 176 sliding along support shaft 174 to insert end 188 within opening 146. During the exercise mode of exercise machine 10, strain gauge 172 is disconnected and does not move with movement arm 30.

Figure 10:
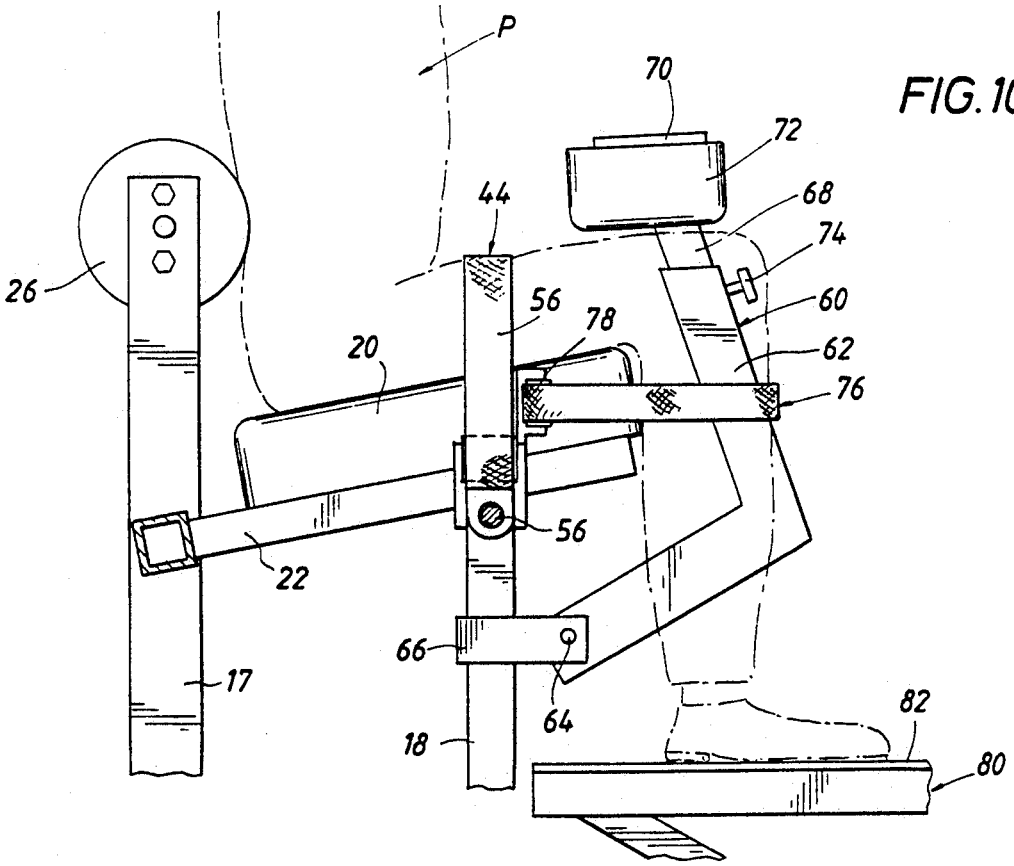
FIG. 10 is a side elevational view of the arrangement shown in FIG. 9 showing the upper leg restraint device over the thighs adjacent the knees with the back of the user supported against a lower back rest.

Prior to the establishing of an exercise or rehabilitation program, the static strength of the lumbar muscles is first determined over a range of different angular positions of the spine between a bent forward position as shown in FIG. 12 and an extended position as shown in FIG. 10. For static testing, strain gauge 172 is in engaged position with arm 140 of pulley wheel 132 and releasable lock means 156 is positioned within a selected opening 160 of pulley wheel 132 as shown in FIG. 6. Measurements from strain gauge 172 are taken from a predetermined number of selected openings 160 in wheel 132 by movement of locking means 156 as shown in FIG. 7. A graph of the static strength is produced and recorded through a computer and displayed on a pair of computer monitors, one computer monitor being shown at 128 (FIG. 1) for viewing by the user or patient and the other monitor (not shown) adjacent a computer for viewing by an operator or technician for exercise machine 10. A keyboard, printer, and mouse (not shown) are also provided adjacent the computer for operation by an operator or technician of exercise machine 10 and an exercise program may be displayed on the monitor.

After the static strength is determined, strain gauge 172 is disconnected from arm 140 by outward movement of handle 186 to the position shown in FIG. 8. In this position, pulley wheel 132 is connected by cable 134 to a selected resistance weight from weight stack 131 and an exercise program for exercising the lumbar muscles by pivoting movement of arm 30 in a rearward counterclockwise direction and return movement of arm 30 in a forward clockwise direction is established. In the rearward counterclockwise direction, force is exerted by the back of a user against back rest 32 as shown in FIG. 12 for performing positive work in lifting the weight stack until the pivoting of movement arm 30 is stopped by stop 166 engaging bar 168 as shown in FIG. 5 with pointer 152 at 0° on scale 154. Then, the lifted weight stack urges pulley wheel 132 in a clockwise return position resisted by the back of the user until arm 140 engages stop 144 at the set position of lever 148 such as 35° as shown in FIG. 5. In some instances, it may not be desired for movement arm 30 to be stopped by stop 166.

During the exercise mode of exercise machine 10, the pelvis of a user moves back and forth in a rocking movement a limited amount as shown particularly in FIG. 12 by the distance D and visually observed by the rotation of back rests 26. The distance D will vary dependent on such factors as the size of the user and the arcuate travel of movement arm 30 in an exercise cycle. For example, an exercise cycle having an arcuate travel of 70° would provide a maximum distance D for rocking of the pelvis of a user while an arcuate travel of 35° would provide a lesser distance D or rocking movement of the pelvis of the user during exercising. Generally, distance D as may be determined by the amount of rotation of lower back rest 26 is between one (1) and two (2) inches. Thus, the exercise cycle may be provided with a minimum of discomfort to the user as a result of not being required to be strapped unusually tight in a seated position for exercising the lumbar muscles.

OPERATION

In operation and referring first to FIGS. 9–12 in which the positioning and securement of a user or patient P is illustrated, FIG. 9 shows the patient P in a seated position on seat 20 with the feet supported on horizontal platform 80. First, lap strap 44 is releasably buckled at 48 and hand wheel 58 is then rotated to move blocks 54 for tightening lap strap 44. Next, leg restraint device 60 is positioned between the legs of patient P and is lowered by manual actuation of plunger 74 with leg pads 72 engaging the thighs closely adjacent the knees. Then, lower leg strap 76 is releasably secured about the lower legs or tibias which are in a generally vertical position as shown in FIG. 10. Now, horizontal platform 80 is raised by manual operation of hand wheel 122 to push the tibias against leg pads 72 for tightly holding the legs therebetween. In this position, static testing of the lumbar muscles is commenced.

Static testing of the lumbar muscles is now performed as set forth above with strain gauge 172 engaged as shown in FIG. 6 and locking means 156 engaging a selected opening 160 in pulley wheel 132. Strain gauge 172 measures the torque exerted by the user when pressing rearwardly against back pad 32 of movement arm 30. Torque readings are taken from a predetermined number of angular positions of movement arm 30 as determined by lever 148 being releasably secured at a predetermined angular relation to pulley wheel 132.

After completion of the static testing, strain gauge 172 is disconnected from arm 140 as shown in FIG. 8 and an exercise program may be commenced with a predetermined weight resistance and a predetermined arc of travel of movement arm 30 between stops 144 and 168 which may vary from around 15° to 70°, for example. Under certain conditions, it may be desirable to test a patient with various resistance weights to determine the work capacity of a patient before an exercise or rehabilitation program is established for a patient. Thus, a safe and effective exercise or rehabilitation program may be provided for each patient.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. An exercise machine (10) for exercising lumbar muscles of a seated user comprising:

a seat (20) on which a user is seated for operation of the machine;

a movement arm (30) mounted for pivotal movement with a horizontal shaft (38, 36) and having an upper back pad (32) thereon for contact with the back of the user for pivoting of the movement arm in a rearward direction by the user exerting force against the back pad;

means (131) operatively connected to said movement arm to provide a predetermined resistance against pivoting of said movement arm by said user in a rearward direction;

a lower back pad (26) mounted for relative movement on said machine for contact with the lower back of the user adjacent the pelvis;

a generally horizontally extending lower platform (80) for supporting the feet of the user with the tibias extending in a generally vertical direction;

an adjustable leg restraint device (60, 72) positioned over the thighs adjacent the knees of the user and generally over said platform for restraining the knees and tibias against vertical movement with at least a portion of said leg restraint device extending forwardly beyond said seat;

manually actuated means (74, 68, 62) operatively connected to said leg restraint device to permit selective vertical adjustment of said leg restraint device relative to said seat and the thighs of the user;

means mounting said platform (90) for vertical movement relative to said leg restraint device after positioning of the feet of a user on the platform beneath said leg restraint device with the tibias being in a vertical position; and manually actuated means (122, 118, 116, 114, 112, 110) operatively connected to said mounting means to permit selective upward vertical movement of said platform relative to said leg restraint device for exerting a compressive force against the tibias between said platform and said leg restraint device while permitting movement of the pelvis and simultaneous movement of said lower back pad during exercising.

2. The exercise machine as set forth in claim 1 wherein said mounting means comprises a slide mounted for reciprocable movement in a generally horizontal direction, and links pivotally mounted between said slide and said horizontal platform for vertical movement of said platform upon horizontal movement of said slide.

3. The exercise machine as set forth in claim 2 wherein said second mentioned manually actuated means comprises a hand wheel adapted to be manually rotated by an operator of said machine;

a horizontal shaft secured to said hand wheel for rotation therewith; and means operatively connected between said shaft and said slide for sliding horizontal movement of said slide upon rotation of said hand wheel.

4. The exercise machine as set forth in claim 3 wherein said means operatively connected between said horizontal shaft and said slide includes a second horizontal shaft having one end threadedly connected to said slide, and a vertical shaft connected between said horizontal shafts for transferring rotative movement from the first mentioned horizontal shaft to said second horizontal shaft.

5. The exercise machine as set forth in claim 1 wherein an adjustable lap strap (46) is releasably connected across the thighs of the user seated on the seat for holding the thighs in a restrained position; and means are operatively connected to said lap strap for tightening said lap strap under a predetermined tension across the thighs of the user.

6. The exercise machine as set forth in claim 5 wherein a lower adjustable leg strap (76) is releasably connected across the legs of the user beneath said leg restraint device and below the knees for holding the tibias against horizontal movement.

7. The exercise machine as set forth in claim 5 wherein a lower back pad (26) is provided adjacent said seat for fitting against and restraining the lower back and pelvis of the user, the user upon exerting a force against said lower back pad for pivoting said movement arm rearwardly providing a limited rocking movement of the pelvis during movement of said movement arm.

8. The exercise machine as set forth in claim 1 wherein said adjustable leg restraint device comprises a post (60) positioned between the legs of a user and mounted for pivotal movement about a horizontal axis, and leg pads (72) mounted on said post for adjustable vertical movement relative to the thighs of the user for engaging the thighs adjacent the knees.

9. An exercise machine as set forth in claim 1 wherein said means operatively connected to said movement arm to provide a predetermined resistance includes a weight stack (131) and means selectively connecting said weight stack to said movement arm to resist pivotal movement of said movement arm exerted by said user in a rearward direction from a rest position.

10. An exercise machine as set forth in claim 9 wherein said weight stack and means selectively connecting said weight stack to said arm continuously urge said movement arm in a forward pivotal movement to said rest position after pivoting rearwardly from said rest position.

11. An exercise machine as set forth in claim 10 wherein said means selectively connecting said weight stack to said movement arm comprises:

a pulley wheel (132) mounted for relative rotation about said horizontal shaft (38) of said movement arm;

a cable (134) extending from said pulley wheel to said weight stack; and a lever (148) secured to the horizontal shaft (38) of said movement arm (30) and releasably connected to said pulley wheel (132) at a predetermined angular relation of said movement arm with said pulley wheel (132) for transferring rotative movement of said movement arm to said pulley wheel.

12. An exercise machine as set forth in claim 11 further comprising a strain gauge means for measuring the torque exerted by said movement arm in a rearward direction from said rest position; and means for selectively connecting said strain gauge to said pulley wheel for measuring the torque exerted by a user against said movement arm in a rearward direction.

13. An exercise machine (10) for exercising lumbar muscles of a seated user comprising:

a seat (20) on which a user is seated for operation of the machine;

a movement arm (30) mounted for pivotal movement with a horizontal shaft (38, 36) and having an upper back pad (32) thereon for contact with the back of the user for pivoting of the movement arm in a rearward direction by the user exerting force against the back pad;

means (131) operatively connected to said movement arm to provide a predetermined resistance against pivoting of said movement arm by said user in a rearward direction;

a lower back pad (26) mounted on said machine for relative movement for contact with the lower back of the user adjacent the pelvis;

a generally horizontally extending lower platform (80) for supporting the feet of the user with the tibias extending in a generally vertical direction;

a vertically adjustable leg restraint device (60, 72) positioned over the thighs adjacent the knees of the user and generally over said platform for restraining the knees and tibias against vertical movement;

means mounting said platform (90) for vertical movement relative to said leg restraint device after positioning of the feet of a user on the platform with the tibias being in a vertical position;

manually actuated means (122, 118, 116, 114, 112, 110) operatively connected to said mounting means to permit selective upward vertical movement of said platform at variable positions relative to said leg restraint device after positioning of the feet of the user on the platform for exerting a compressive force against the tibias between said platform and said leg restraint device while permitting vertical movement of the pelvis and simultaneous movement of said lower back pad during exercising; and a lower adjustable leg strap (76) releasably connected across the legs of the user in a generally horizontal plane beneath said leg restraint device and below the knees for holding the tibias against horizontal movement upon upward vertical movement of said platform.

14. The exercise machine as set forth in claim 13 wherein an adjustable lap strap adjacent said leg restraint device extends in a generally vertical plane and is releasably connected across the thighs of the user seated on the seat for holding the thighs in a restrained position against said seat; and manual means (58, 56, 54) is operatively connected to said lap strap for tightening said lap strap under a predetermined tension across the thighs of the user.

15. The exercise machine as set forth in claim 14 wherein said manual means operatively connected to said lap strap comprises:

a hand wheel adapted to be rotated by an operator of said machine;

a horizontal shaft secured to said hand wheel for rotation therewith; and means operatively connected between said shaft and opposed lower ends of said lap strap for selectively pulling said opposed ends toward each other for tightening said lap strap against said thighs upon rotation of said hand wheel.

* * * * *